United States Patent [19]

Pötschke

[11] Patent Number: 4,761,161

[45] Date of Patent: Aug. 2, 1988

[54] PROCESS FOR IMPROVING THE DYEING OF CELLULOSIC MATERIALS WITH REACTIVE OR SUBSTANTIVE DYES UTILIZING MILK PROTEIN AS A LEVELING AGENT

[76] Inventor: Dénes Pötschke, Bismarckstr. 22, 7312 Kirchheim/Teck, Fed. Rep. of Germany

[21] Appl. No.: 892,879

[22] Filed: Jul. 28, 1986

Related U.S. Application Data

[63] Continuation of Ser. No. 518,941, Aug. 1, 1983, abandoned.

[30] Foreign Application Priority Data

Jul. 30, 1982 [DE] Fed. Rep. of Germany ..... 3228479

[51] Int. Cl.[4] ..... D06P 3/66

[52] U.S. Cl. ..... 8/543; 8/563; 252/89.1

[58] Field of Search ..... 252/8.6, 89.1, 173, 252/DIG. 14; 8/115.6, 543, 563

[56] References Cited

U.S. PATENT DOCUMENTS 2,894,801 7/1959 Paul ..... 8/563
4,268,266 5/1981 Hendricks et al. ..... 8/543
4,311,480 1/1982 Price et al. ..... 8/563
4,501,589 2/1985 Oschatz ..... 8/495

FOREIGN PATENT DOCUMENTS 48590 12/1974 Japan .

OTHER PUBLICATIONS

Classification of Dyes, Encyclopedia of Chemical Technology, vol. 5, pp. 345–414, 1954.
Dye, Encyclopedia of Science and Technology, 5th Edition, pp. 420–435, 1982.

*Primary Examiner*—A. Lionel Clingman
*Assistant Examiner*—Hoa Van Le
*Attorney, Agent, or Firm*—Brumbaugh, Graves, Donohue & Raymond

[57] ABSTRACT

The invention relates to a cleaning agent, particularly for textiles which has a content of milk proteins. Milk proteins are suitable for an at least partial substitution of the polyphosphates contained in conventional detergents. However, they are particularly advantageously used in textile dyeing and high pressure cleaning. With particular advantage, they can be added together with a surfactant mixture.

16 Claims, No Drawings

PROCESS FOR IMPROVING THE DYEING OF CELLULOSIC MATERIALS WITH REACTIVE OR SUBSTANTIVE DYES UTILIZING MILK PROTEIN AS A LEVELING AGENT

This application is a continuation of application Ser. No. 518,941, filed on 8/1/83, now abandoned.

BACKGROUND OF THE INVENTION

The invention relates to a cleaning agent, particularly for textiles. The presently used detergents for textiles contain polyphosphates. As a result, large polyphosphate quantities enter rivers, which constitutes a serious environmental protection problem. Therefore, for a considerable time, great efforts have been made to find suitable substitutes for polyphosphates. However, as yet, no satisfactory solution has been found.

Therefore, the problem of the present invention is to provide a treatment agent, particularly for textiles, or to make available an additive for such treatment agents, with the aim of reducing the polyphosphate content of conventional treatment agents or even to completely eliminate polyphosphates and other phosphorus compounds.

SUMMARY OF THE INVENTION

The invention is based on the fact that the cleaning or treatment agent contains milk protein. It has surprisingly been found that milk protein, due to its structure, is in a position to largely assume the action of the hitherto used phosphates, in conjunction with other conventional treatment or cleaning agent constituents. Unlike polyphosphates, milk protein is degradable, so that it does not cause environmental problems. Milk protein is a by-product obtained in large quantities during milk processing, for which the present invention has also found a use.

The milk protein can consist of protein mixtures, which can contain albumins and globulins. Preference is given to casein or caseinates. Casein has long been known as an additive for soaps, so that in "Ullmann, Enzyklopädie der technischen Chemie", Vol. 3, 1916, pp.292 to 297, particularly p.297, it is pointed out that toilet soaps can be augmented and improved in quality by adding 10% casein solution. The soap is made more gentle and durable and has a higher lathering power. It is also known to use a quantity of 0.25 to 5% by weight of casein in a dishwashing agent, particularly intended for washing dishes by hand. The function of the casein is then to replace alkyl benzene sulphonates, alkyl sulphonates and alkyl sulphates, because these have a tendency to disadvantageously influence the softness characteristics and also the dripping/drying under soft water conditions. Thus, DOS No. 2,748,800 deals with the special problems of hand dishwashing agents. DOS No. 2,607,656 describes a washing and cleaning agent, which can contain casein in addition to phosphorus compounds.

Even very small amounts of milk proteins permit a considerable reduction of the polyphosphate content. Normally, milk protein is present in the dry substance of a detergent in quantities of more than 5 to 20% by weight, particularly 7 to 15% by weight. In special cases, the proportion can also be higher, particularly if the detergent only contains the normally used main constituents, such as surfactants and the like. It has proved advantageous if the detergent additionally also contains at least one softener, preference being given to phosphate-free softeners. Such softening agents are, for example, sodium aluminosilicates, such as zeolites, as well as complexing agents, such as ethylene diamine tetraacetic acid, nitriloacetic acids, etc. Such softeners or chelating agents are preferably contained in the detergent according to the invention, because they fully bring out the action of casein as a tripolyphosphate substitute.

Milk protein, particularly casein, is commercially available generally in powder form, which is difficult to dissolve in water. However, by increasing the pH-value casein can be made soluble in known manner. Preference is given to solubilization using ammonium hydroxide, but other soluble caseinates can also be used. Normally, the detergent according to the invention contains 5 to 20% by weight of alkylbenzene sulphonate, 20 to 35% by weight of sodium percarbonate and/or sodium perborate, 3 to 15% by weight alkali silicate and 5 to 30% by weight casein, preference being given to an addition of 5 to 15% by weight to at least one softener. In addition, the detergent according to the invention can contain further conventional constituents, such as cellulose derivatives, fatty alcohol hydroxyethylates, sodium sulphate and further additional washing aids, such as sodium soaps as lather-preventing agents. The cleaning or treatment agent is preferably free from phosphorus compounds.

The cleaning agent according to the invention is particularly suitable as a detergent for textiles and namely as a detergent which can be used when washing at both 60° and 90° C. Only a main washing process is required, i.e. there is no need for a preliminary washing process or a soft washing process. This can be attributed to the special dirt dissolving and suspending properties of milk protein. There is also no need to add sodium sulphate to the detergent, which further reduces the amount of salt in the waste water or sewage. The detergent is suitable for use in washing machines, not only in the home, but also in large laundries, hospitals, etc. There is no redeposition of dirt.

However, the cleaning agent according to the invention can also be used in other fields, such as as a textile aid or an additive for the same, e.g. for washing or cleaning textile articles before, during and after dyeing. Milk protein is particularly valuable when used for levelling stained dyes articles. It has been found that stains and other discolourations can be removed in a single washing process using the cleaning agent according to the invention, whereby this still takes place in a careful and gentle manner, where all commercially available chemicals, such as e.g. reducing agents of the hydrosulphite type with caustic soda solution fail.

The cleaning agent according to the invention is also suitable for cleaning very dirty objects, such as machines, equipment, ship hulls, aircraft fuselages and swimming pools, when it is preferably used in connection with high pressure cleaning. Use is then made of the special capacity of milk proteins to dissolve large dirt particles. Thus, it is not necessary to completely dissolve the large, thick dirt areas and it is in fact merely necessary to dissolve the dirt in the form of particles of varying size.

If the cleaning agent according to the invention is to be used as a detergent for textiles, then it is normally in dry form, e.g. as a free-flowing powder. For a washing process, it is generally sufficient to have detergent quantities of e.g. 200 g, compared with the otherwise necessary 250 g in known detergents for preliminary and main washing processes. The reduced weight alone decreases the burden to the sewage system, to which must be added the good biodegradability of milk proteins. Through economizing on a preliminary and a soft washing process, water and energy are also saved. Through the good dirt-suspending properties of milk proteins, both a good dissolving of the dirt and a softening of the textile fibres are obtained. Simultaneously and unlike in the case of other known detergents, the breaking load of the textiles is not reduced by the detergent according to the invention.

However, the cleaning agent according to the invention can also be in liquid form, which is preferred if other constituents of the cleaning agents are in any case in liquid form. This is particularly so when using as a textile aid. When the cleaning agent is in liquid form, it appropriately also contains a preserving agent, in order to prevent bacterial decomposition of the milk protein.

DESCRIPTION OF PREFERRED EMBODIMENTS

Further features and advantages of the invention can be gathered from the following examples, in conjunction with the subclaims.

EXAMPLE 1

A detergent is made according to the following formulation for a commercially available heavy-duty detergent:

| Active substance group | Example | Percentage proportion |
|---|---|---|
| Surfactants | Alkylbenzene sulphonates, fatty alcoholethoxylates, soaps. | 11–17 |
| Complexing agents | Pentasodiumtripolyphosphate | 25–40 |
| Bleaching agents | Sodium perborate tetrahydrate or sodium percarbonate | 20–30<br>18–25 |
| Stabilizers | Magnesium silicate | 2–4 |
| For perboate | Ethylene diamine tetraacetate | 0.2 |
| Greying inhibitors | Carboxymethylcellulose | 1–2 |
| Lather regulators | Long-chain soaps, such as e.g. tallow soap containing behenate | 2–4 |
| | Long-chain alkyl phosphate | 0.3–1 |
| Corrosion inhibitors | Sodium disilicate | 5–8 |
| Optical brighteners | Stilbene and pyrazoline derivatives | 0.1–0.3 |
| Enzymes | Proteases | 0–1 |

but the 25 to 40% tripolyphosphate (TPP) are replaced by 15% of water-soluble casein and 6% of zeolite. Thus, a comparison of the two detergents during tests reveals that the detergent power is the same. Tests have also shown that, without any significant deterioration, the fatty alcohol ethoxylate and the sodium sulphate can be omitted. The phosphate and salt contents of the water are considerably reduced by the polyphosphate and sodium sulphate savings.

EXAMPLE 2

A detergent suitable for washing at 60° C. has the following composition:

| Active substance group | Product used | Proportions |
|---|---|---|
| Surfactants | 100% sodium dodecylbenzene sulphonate | 10 parts |
| | Nonyl phenol polyglycol ether 9 AeO | 2 parts |
| | 100% sodium cumene sulphonate | 2 parts |
| Complexing agents | Zeolite A = sodium aluminosilicate | 10 parts |
| Bleaching agents | Sodium percarbonate | 20 parts |
| Stabilizers | Magnesium silicate | 2 parts |
| Greying inhibitors | Carboxymethylcellulose | 1 part |
| Corrosion inhibitors | Sodium disilicate | 5 parts |
| Milk protein | Water-soluble casein powder | 12 parts |
| Optical brighteners | Stilbene derivatives | 0.4 parts |
| Softeners | Fatty amide polyglycol ether | 5 parts |
| Perfume | Natural and synthetic odoriferous substances | 0.2 parts |
| Preserving agent | Only necessary if casein used in aqueous form: 72% sodium-3-methyl-4-chlorophenolate | 0.2 parts |

The advantage provided by the invention is particularly here, because heavy-duty detergents, especially when intended for use at 60° C., normally have a very high phosphate content. There is also a water saving and consequently a reduced burden on the sewage system, because with the phosphate-free detergent, it is only necessary to have a main washing process, with softener action.

Great importance is attached to the biological-chemical degradability of casein, whereas tripolyphosphate can only by eliminated from the sewage system by settling, which cannot be financially justified and which causes the eutrophication of all water courses.

Numerous washing tests at 60° C., without preliminary washing and without softener rinsing, were carried out as comparison tests and revealed that clothes washed with the detergent according to the invention have better cleanness, whiteness and ironing characteristics than clothes rinsed with conventional phosphate-containing detergents.

EXAMPLE 3

This example shows further compositions of phosphate-free detergents.

| Domestic detergent formulations in parts by weight up to 100 | |
|---|---|
| 5–12 | 90% dodecylbenzenesulphonate |
| 2–6 | Oxo alcohol + 10 ethyleneoxide or 8–12 ethyleneoxide |
| 2–6 | Sodium tallow fatty acid |
| 10–18 | Acid casein or caseinates |
| 10–18 | Sodium aluminosilicate or corresponding phosphorus-free softeners not prejudicial to the environment. |
| 20–25 | Sodium perborate tetrahydrate. |
| 5–8 | Sodium metasilicate pentahydrate |
| 1–4 | Fatty amide condensate with hydroxyethylate |
| 1–3 | Carboxymethylcellulose |
| 0.2–0.8 | Optical brightener for cellulose |
| 0.2–0.5 | Optical brightener for synthetics |
| up to 100% | with sodium sulphate |

Use in the washing machine: 200 to 220 g of detergent for 4.5 kg of washing without preliminary washing and without a soft rinsing process at 50, 60 or 90/95° C.

EXAMPLE 4

Cellulose mesh or stitched articles dyed unlevel from the stain standpoint with reactive and substantive dyes cannot be improved in stain-free and colour-level manner with all the hitherto known levelling and stripping (dye removing) textile aids and chemicals. Using a casein-containing levelling agents with the following composition, all these off-shade dyeing effects are prepared in stain-free/colour-level manner in a decoction process:

50 parts by weight casein (100% powder)
25 parts by weight urea
10 parts by weight sodium carbonate
10 parts by weight alkyl polyglycolether to be dissolved with 10 times the quantity of boiling water, accompanied by stirring, and
5 parts by weight of isotridecyl alcohol, plus
8 moles of ethylene oxide added thereto.

Liquor ratio: 1:15 to 1:20 kg of articles per liter of liquor.
Quantity used: 10 g/l of above solution
Temperature: Start at 40° C. and heat to 98° C.
Standing time: Allow to circulate for 90 min. at 98° C.
Then: Drain off and cold rinse twice.
Result: Articles approximately 10% lightened or not lightened at all (shade retained). Discolourations have disappeared and articles completely colour-level. No damage to fibres and has a very soft feel.

The following examples 5 to 10 illustrate the use of milk proteins in the form of liquid formulations of decomposed milk protein, which contain preserving agents. The liquid formulations are preferably used in combination with surfactants or surfactant mixtures. When used as a dyeing aid, the milk protein solution can be called a levelling agent and the surfactant solution a corrective agent.

The milk protein solution or levelling agent preferably has the following composition (parts by weight-/parts by volume):

10–16 parts casein or caseinates as powder
0.8–1.2 parts of 25% ammonium hydroxide
0.8–1.2 parts preserving agent, topped up to 100 parts by volume of water The surfactant mixture or corrective agent can have the following composition (parts by weight/parts by volume):

5–15 parts alkyl polyglycolether
5–10 parts diethylene glycol monobutylether (or similar glycols) as solubilizer
5–10 parts methoxypropanolamino salts as cleaning intensifier
5–15 parts tridecyl alcohols with 5 to 8 parts ethyleneoxide
1–3 parts sodium cumene sulphonate (powder)
1–8 industrial alcohols, e.g. isopropanol, topped up to 100 parts by volume of water.

The aforementioned milk protein solution can be used alone in the textile industry, e.g. as a levelling agent. However, when it is necessary to intensify the cleaning action, the levelling agent or milk protein is preferably used in combination with the corrective agent (surfactant mixture). The ratio of the levelling agent to the corrective agent is between 1:2 and 2:1, preference being given to 1:1. The levelling agent preferably contains 5 to 20% by weight of soluble milk protein (caseinates) and an adequate quantity of preserving agent. The corrective agent generally contains 20 to 60% by weight of wetting agent and water-soluble organic solvents. The levelling agent and corrective agents are preferably prepared and used in the form of a joint liquid mixture. Based on the solids content, the latter can contain approximately 10 to 30% by weight casein or caseinate and approximately 90 to 70% by weight of surfactant mixture. As a function of the intended use, this liquid mixture is then diluted several times. The corrective agent is mainly used for stained reactive and direct dyed effects in cellulose articles with a possibility of after-tinting in the scouring bath, as well as for lightening excessively dark reactive-direct dyeing effects on cellulose, as well as for removing oligomers in polyester dyeing effects, as detergents for removing encrustations (of tar, oils, etc), in containers, pads, tenter frames, screens, machines, machine parts, air conditioning systems, aircraft fuselages and vehicle bodies. When used as a detergent for high pressure cleaning, the mixture of the levelling agent and corrective agent is diluted, preferably in a ratio of 1:3 to 1:5, which reduces its viscosity, so that it can be added to the heated water of the higher pressure cleaner. Such a detergent is also suitable for cleaning by decoction, which can be combined with high pressure cleaning in the case of difficultly removable dirt.

EXAMPLE 5

Dyeing aid

In this case, the milk protein is used as a levelling agent for cotton dyeing, particularly cotton meshed articles by means of substantive and reactive dyes in the exhaustion process. The addition of the levelling agent to the dye bath takes place prophylactically, in order to prevent unlevel dyeing.

Quantities used:
0.5 to 2.0 g of liquid levelling agent per liter of liquor (0.05 to 0.35 g of casein/liter of liquor)
Liquor ratio 1:20 to 1:40 kg of articles/liter of liquor.

EXAMPLE 6

Dye-dirt stain remover

The levelling agent and corrective agent, which preferably consists of a mixture of nonionic emulsifiers, detergents and cleaning intensifiers, in combination with one another, remove dye and dirt stains from otherwise uncleanable cotton dyed products, if they have been dyed with substantive and reactive dyes. The dyeing effect remains level throughout and the shade is max. 10% lighter.

Quantities used:
3 to 15 g of levelling agent/liter of liquor (0.3 to 2.5 g of casein/liter of liquor)
3 to 15 g of corrective agent/liter of liquor.

The precise quantities used vary as a function of the intensity of the stains.

Conditions for use: Boiling temperature, duration 90 minutes, liquor ratio 1:10 to 1:20.

EXAMPLE 7

Optical brightener

If as a result of errors (human or mechanical) excessively dark dyeing effects result from substantive or reactive dyes used in cotton dyeing operations, these off-shade dyeing effects can be lightened by milk proteins (levelling agent) combined with nonionic surfactants (corrective agent). No change occurs to the dye fasteness. There is no damage to the fibres, as is the case with bleaching agents. The quantities used are generally larger than when removing dirt and stains and consist of:

10 to 25 g of levelling agent/liter of liquor (1 to 4 g of casein/liter of liquor)

10 to 25 g of corrective agent/liter of liquor.

Liquor ratio: 1:20 to 1:30.

Conditions of use:

60 minutes at boiling temperature.

EXAMPLE 8

Tinting by means of milk protein and surfactant mixture in hot dye bath

If the dye-dirt stain removal (according to example 6), or the optical brightening (according to example 7) have been carried out, or as a result of any other dyeing operation the shade does not correspond to the colour pattern, completely satisfactory after-tinting operations can be carried out in colour-level manner in a bath containing the levelling agent and corrective agent in combination, by means of the addition of substantive dyes in a hot dye bath (with the steam option stopped). There is no need to cool, so that through the addition of additional dyes unlevelness is avoided. The additional dye can be added to the hot liquor.

EXAMPLE 9

Resoaping in cotton fabrics and cotton mesh dyed articles

As is known, reactive, indanthrene, naphthol and sulphur dyed articles must be resoaped, in order to dissolve the non-combined dye and to obtain true dyed colours. Resoaping is carried out according to the invention with a mixture of levelling agents and corrective agents.

Quantities used:

1 to 2 g of levelling agent/liter of liquor (0.1 to 0.35 g of casein/liter of liquor)

1 to 2 g of corrective agent/liter of liquor.

Conditions of use:

10 minutes at boiling temperature.

With a continuous passage of the articles, working takes place with an article speed of 30 to 40 m/minute and a bath temperature of 85° to 95° C. Resoaping is washfast and rubbing-fast. There is no negative influence on other fastnesses, such as light fastness, etc. In the case of raised particles, raising passages and optionally also pad brightening quantities can be reduced.

In all the above-described use examples, apart from the indicated effects, in each case soft articles are obtained, which are comparable with the usual "softener feel".

The special levelling and cleaning action can be attributed to the milk protein, particularly the casein or caseinate. The other chemicals or the corrective agent assist this action. The remaining constituents of the detergent and/or the corrective agent can be replaced by equivalent substances.

EXAMPLE 10

High pressure cleaning agent based on milk proteins

Very dirty machines, equipment, vehicles, ships hulls, aircraft fuselages, inner and outer walls or claddings can be effectively cleaned in the high pressure process using milk protein-containing cleaning agents, even if the dirt could not otherwise be dissolved, or could only be removed with environmentally prejudicial or corrosion chemicals. The combination of levelling agent and corrective agent is also effective in the high pressure cleaning of food plants, private and public swimming pools, sewage treatment plants and containers. When used in the higher pressure cleaner, the thick mixture of corrective agent and levelling agent is initially diluted 3 to 5 times. Approximately, 20 to 60 liters of this solution are then added to 3000 to 5000 liters of heated washing water. Levelling and corrective agents are then present in an approximately 150 to 1250 times dilution (0.08 to 1.3 g/l of washing liquor).

Conditions for use: 70° to 95° C., 70 to 150 bar.

Using a point-like jet, this high pressure cleaning agent can also be successfully used for dissolving sticky and hardened contaminants.

I claim:

1. A process for improving the dyeing of cellulosic materials with reactive or substantive dyes, comprising treating the cellulosic materials with a dye assistant composition comprising a leveling agent, said leveling agent comprising milk protein in an amount effective to level the color imparted to the cellulosic material.

2. A process according to claim 1, wherein the dye assistant composition further comprises a corrective agent comprising from 20% to 60% by weight of wetting agents and water-soluble organic solvents.

3. A process according to claim 2, wherein the leveling agent and the corrective agent are added to a liquor containing the cellulosic material in ratios of between 1:2 and 2:1.

4. A process according to claim 1, wherein the cellulosic materials are treated with from 0.05 g to 0.35 g of milk protein per liter of liquor.

5. A process according to claim 2, wherein the cellulosic materials are treated with from 0.3 to 2.5 g of milk protein per liter of liquor.

6. A process according to claim 2, wherein the cellulosic material is treated with from 10 to 25 g of milk protein per liter of liquor and from 10 to 25 g of corrective agent per liter of liquor.

7. A process according to claim 1 wherein the cellulosic material is treated by soaking in a liquid containing the milk protein at elevated temperature.

8. A method for leveling the coloration imparted to a cellulosic material during dyeing with a reactive or substantive dye, comprising treating the cellulosic material with a dye assistant composition comprising a leveling agent comprising milk protein in an amount effective to level the color imparted to the cellulosic material.

9. A method according to claim 8, wherein the dye assistant composition further comprises a corrective agent comprising from 20% to 60% by weight of wetting agents and water-soluble organic solvents.

10. A method according to claim 9, wherein the leveling agent and the corrective agent are added to a liquor containing cellulosic material in ratios of between 1:2 and 2:1.

11. A method according to claim 8, wherein the dye assistant composition is added to a dye bath containing the cellulosic materials and the reactive or substantive dyes.

12. A method according to claim 11, wherein the cellulosic materials are treated with from 0.05 to 0.35 g of milk protein per liter of liquor in the dye bath.

13. A method according to claim 9, wherein the dye assistant composition is added to a bath containing cellulosic materials previously dyed with reactive or substantive dyes.

14. A method according to claim 13, wherein the cellulosic materials are treated with from 0.3 to 2.5 g of milk protein per liter of liquor.

15. A method according to claim 9, wherein the cellulosic material is treated with from 10 to 25 g of milk protein per liter of liquor and from 10 to 25 g of corrective agent per liter of liquor such that the dyed cellulosic materials are brightened and leveled.

16. A method according to claim 8, wherein the cellulosic material is treated by soaking in a liquid containing milk protein at elevated temperature.

* * * * *

UNITED STATES PATENT AND TRADEMARK OFFICE

CERTIFICATE OF CORRECTION

PATENT NO. : 4,761,161

DATED : August 2, 1988

INVENTOR(S) : Denes Potschke

It is certified that error appears in the above-identified patent and that said Letters Patent is hereby corrected as shown below:

First page, Item [56] References Cited, U.S. Patent Documents, under "4,501,589 2/1985 Oschartz..... 8/495 insert --4,079,020 3/1978 Mills et al. ..... 252/547; 4,114,201 9/1978 Garrison ..... 2/171.1; 4,179,391 12/1979 Kaufmann et al. ..... 252/99; 4,434,089 02/1984 Billington et al. ..... 252/548--.

First page, Item [56] Foreign Patent Documents, Col. 2, under "48590 12/1974 Japan" insert --2,748,800 5/1978 Germany; 2,607,656 9/1976 Germany; 2,650,971 5/1977 Germany; 1,536,136 12/1978 Great Britain; 1,538,174 1/1979 Great Britain; 1,562,793 3/1980 Great Britain--.

Signed and Sealed this

Twenty-first Day of March, 1989

*Attest:*

*Attesting Officer*

DONALD J. QUIGG

*Commissioner of Patents and Trademarks*